United States Patent [19]

Hatsuse

[11] 3,942,437

[45] Mar. 9, 1976

[54] CHAIN PRINTER

[75] Inventor: Toshikazu Hatsuse, Tanashi, Japan

[73] Assignee: Citizen Watch Co., Ltd., Tokyo, Japan

[22] Filed: June 17, 1974

[21] Appl. No.: 479,608

[30] Foreign Application Priority Data

June 30, 1973 Japan ..... 48-77880[U]
Jan. 14, 1974 Japan ..... 49-7594[U]

[52] U.S. Cl. ..... 101/111
[51] Int. Cl.[2] ..... B41J 1/20
[58] Field of Search ..... 101/111, 93 C, 93, 14; 24/206, 170; 132/46, 48

[56] References Cited

UNITED STATES PATENTS

| | | | |
|---|---|---|---|
| 2,897,825 | 8/1959 | Wagner | 132/48 R |
| 3,142,249 | 7/1964 | Sasaki | 101/111 |
| 3,379,125 | 4/1968 | Antonucci | 101/111 X |
| 3,630,144 | 12/1971 | Hillpert et al. | 101/111 |
| 3,633,500 | 1/1972 | Edwards et al. | 101/111 |
| 3,638,565 | 2/1972 | Doejza et al. | 101/111 |
| 3,745,918 | 7/1973 | Perry et al. | 101/111 |

*Primary Examiner*—Edgar S. Burr
*Assistant Examiner*—E. M. Coven
*Attorney, Agent, or Firm*—Spensley, Horn and Lubitz

[57] ABSTRACT

This chain printer has a type chain which includes an endless flexible belt capable of installing numerous type slugs. Each print slug includes a printing portion containing at least one type character and a pair of cantilevers extending from the printing portion. The print slugs are changeably mounted onto the belt by means of a U-shaped spring which permits a better printing performance and a simplified type-changing process.

7 Claims, 11 Drawing Figures

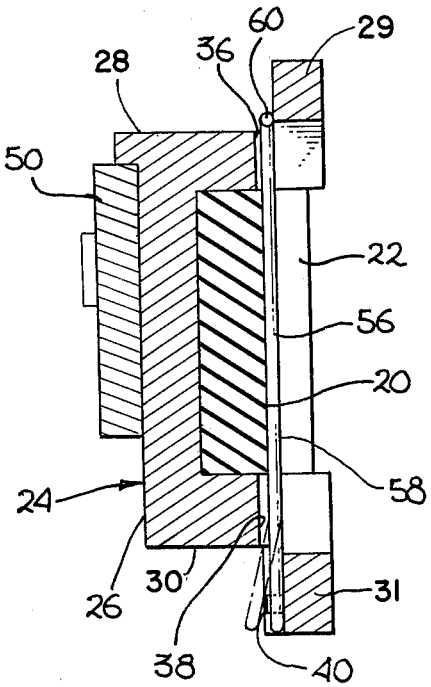
Fig. 3
Fig. 4
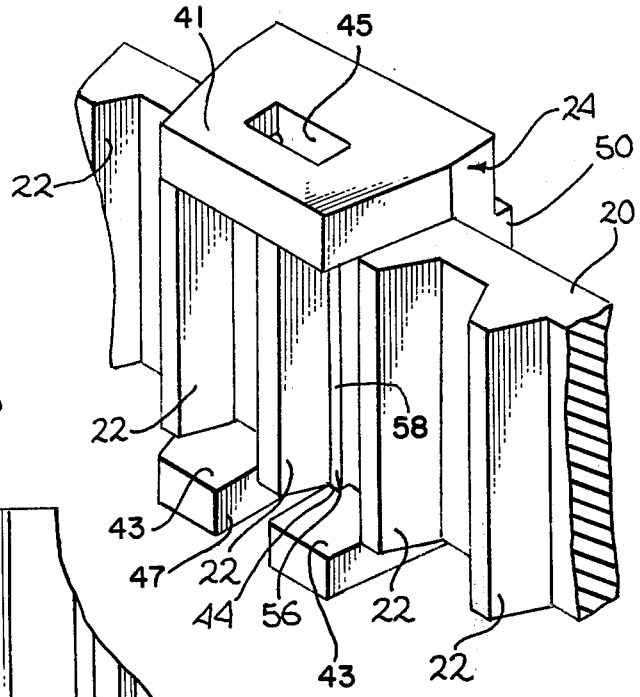
Fig. 5
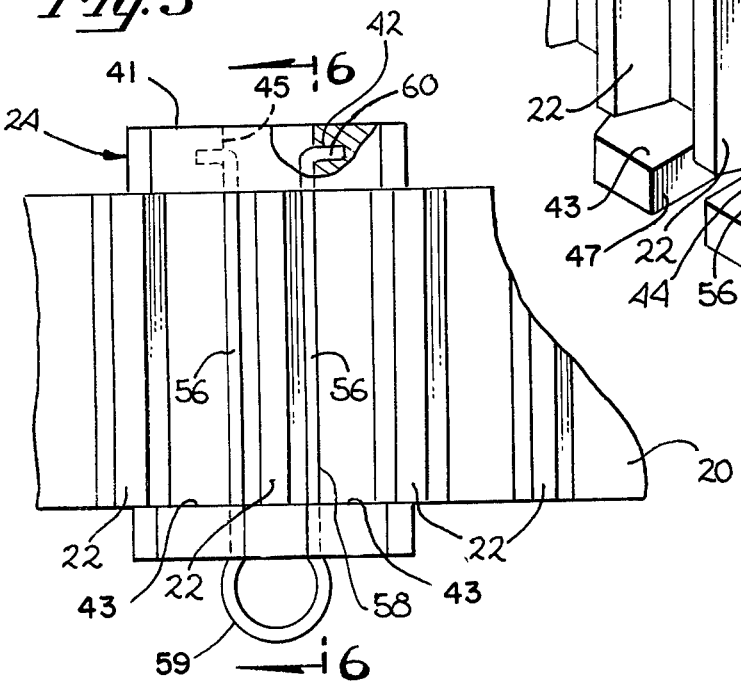

CHAIN PRINTER

BACKGROUND OF THE INVENTION

1. Field of the Invention

This invention relates to chain printers and, more particularly, to an improved type belt for a chain printer.

2. Prior Art

The prior art to which this invention is directed teaches an arrangement for the type belt for a chain printer in which the print slug is fixed to the timing belt by means of pins mounted into extensions of the print slug and elongated coil springs. These are disclosed by U.S. Pat. Nos. 3,621,778 and 3,633,500. However, the above described system has some disadvantages. First, it consumes a considerable amount of time in mounting and demounting the print slugs from the timing belt, and in addition a greater number of parts are required. Another disadvantage of the prior art is the manufacturing complexity. That is, the system necessitates an intricate configuration of parts in order for the timing belt to gear properly with the driving pulley. In the case of U.S. Pat. No. 3,633,500, the shape of the driving pulley must be so designed as to avoid the interference between the driving pulley and the elongated coil springs, while in the case of U.S. Pat. No. 3,621,778, the pin mounted onto the extension of the printing slug is divided into upper and lower parts to protect it from interference between the pin and the printing slug. Accordingly, a longer time is spent in the manufacturing process of the devices described above. In addition, the arrangement in which the timing belt engages the driving pulley is likely to cause wear and tear of the timing belt after some period of operation. This will result in the deterioration of the printing performance of the device.

This invention solves these problems which the prior art devices described above have failed to solve.

BRIEF SUMMARY OF THE INVENTION

It is the primary object of this invention to provide a type belt that has fewer parts and that will simplify the process of mounting and demounting print slugs.

Another object of this invention is to provide a type belt arranged in such a manner that the print slugs mounted on the type belt accurately engage the driving pulley.

A further object of this invention is to improve the printing performance and to insure a longer life of the timing belt.

The novel features which are believed to be characteristic of the invention together with further objects and advantages thereof, will be better understood from the following description considered in connection with the accompanying drawings in which presently preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWING

FIG. 3 is a cross-sectional view along Lines III — III shown in FIG. 2.

FIG. 4 is a perspective view of the second embodiment of this invention.

FIG. 5 is a rear view of the second embodiment of this invention.

DETAILED DESCRIPTION OF THE INVENTION

Figure 1:
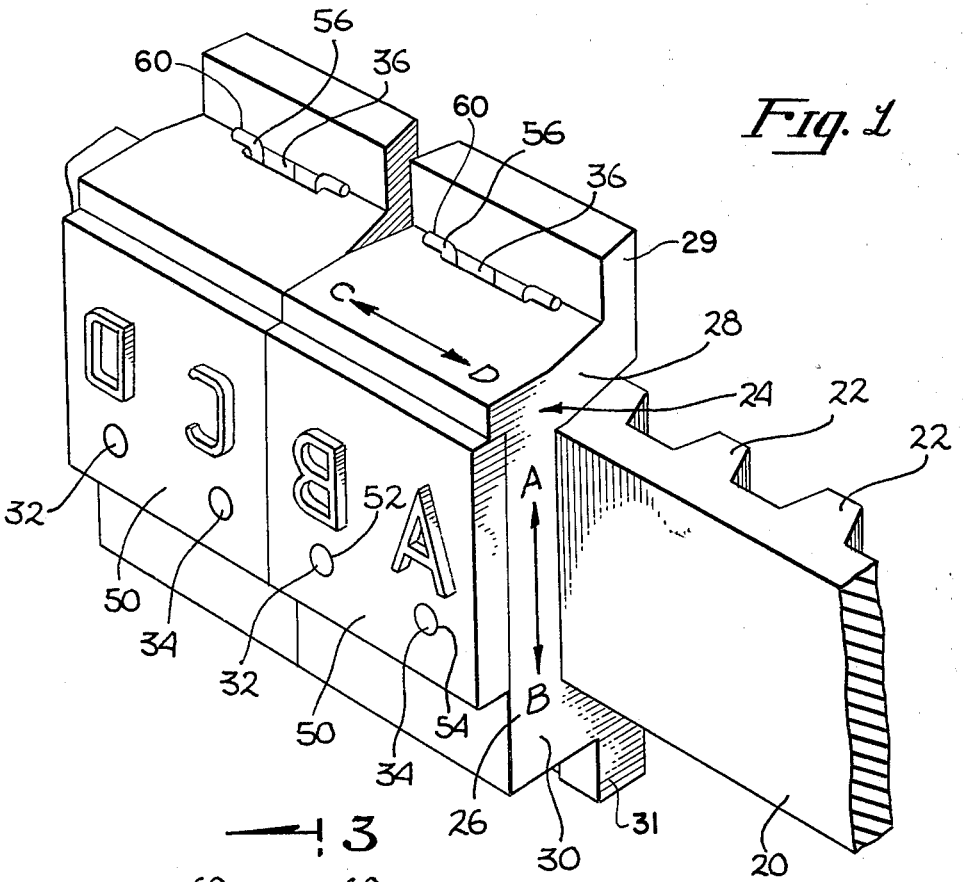
FIG. 1 is a perspective view of the first embodiment of this invention.
Figure 2:
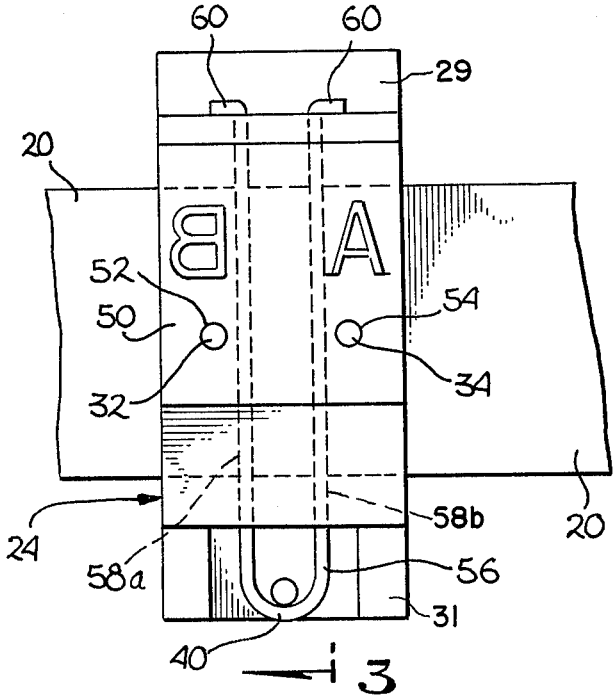
FIG. 2 is a front view of the same embodiment of this invention.
Figure 10:
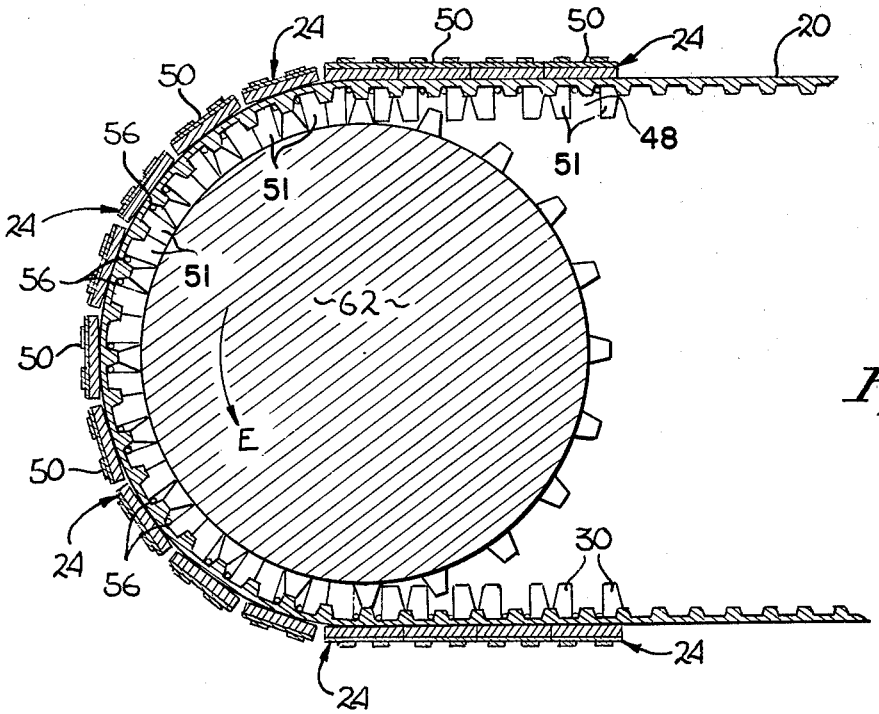
FIG. 10 is a cross-sectional view along Lines X — X shown in FIG. 9.

Referring first to FIGS. 1 through 3, there is shown a preferred embodiment of this invention. FIG. 1 illustrates a perspective view of a part of the device in which print slugs 24 are fixed on timing belt 20 that is flexible and endless having a first and a second side. The second side of timing belt 20 is provided with a plurality of teeth 22, which are arranged and configured to mesh with a driving pulley 62 (FIG. 10). The first side faces print slug 24 and is coupled thereto by means of U-shaped spring members 56. Thus belt 20 is disposed between slugs 24 and U-shaped spring members 56. Print slug 24 comprises printing portion 26 and a pair of upper and lower cantilever members 28 and 30 which extend almost perpendicularly at the upper and lower ends of printing portion 26. Upper cantilever member 28 has projection 29 and lower cantilever 30 has projection 31. The cantilevers and the projections extend from the first side of the belt 20 to the second side thereof. Cantilevers 28 and 30 have a length in excess of the belt's width in order to grip timing belt 20. Cantilevers 28 and 30 in cooperation with U-shaped spring 56 work to prevent the vertical offset (shown by arrows A and B in FIG. 1) of print slug 24 during operation. Type base 50 consisting of two printing types or fonts as a unit is fixed upon printing portion 26 by means of protuberances 32 and 34 of printing portion 26 which fit into holes 52 and 54 provided in type base 50. U-shaped spring 56 (FIG. 2) has bent, outwardly extending portions 60 at the free ends and two straight leg members **58*a* and 58*b*. Spring 56 is so placed that the straight leg members 58*a* and 58*b* capture and hold tooth 22 of timing belt 20 between printing portion 56 and projections 29 and 31 by urging the belt toward printing portion 26. Thus, U-shaped spring 56 prevents horizontal offset (shown by arrows C and D) of print slugs by positioning each tooth member 22 between each leg 58*a* and 58*b*** thereof.

The process of mounting print slugs 24 onto timing belt 20 with U-shaped spring 56 is, for example, as follows:

1. first, as shown in FIG. 3, install print slug 24 upon timing belt 20,
2. then set U-shaped spring 56 through opening 36 and opening 38 provided in cantilevers 28 and 30 respectively,
3. move U-shaped bottom section 59 of spring 56 to the angle shown by the broken line, and 4. finally, fix U-shaped spring 56 to the position shown by the solid line.

This installation procedure results in U-shaped spring 56 abutting the inside wall along opening 36 with bent portion 60 being firmly caught by an upper face of cantilever 28. In additon, bottom section 59 of U-shaped spring 56 is fixed by projection or protuberance 40. Accordingly, the device thus organized assures durability of performance without causing shifting or sliding. In the case of demounting print slugs 24 from timing belt 20, the reverse process shall be followed. Thus, it should be evident that the mounting-demounting process is considerably simplified.

Figure 6:
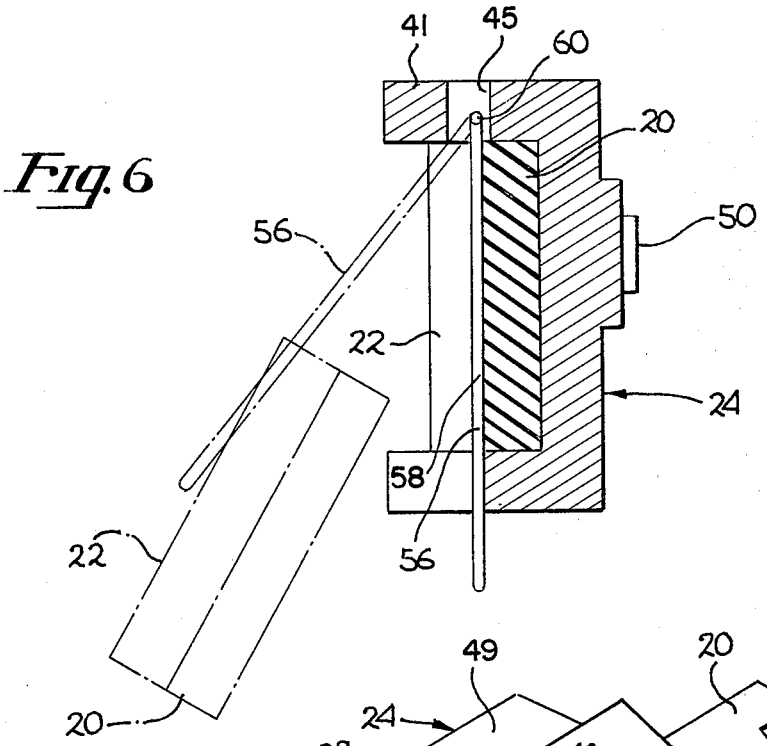
FIG. 6 is a cross-sectional view along Lines VI — VI shown in FIG. 5.

Now referring to FIGS. 4 through 6 which illustrate another embodiment in which print slug 24 and type base 50 are moulded as a single unit, instead of two separate elements as shown in FIGS. 1 through 3. FIG. 4 shows a perspective rear view of a part of the device, where U-shaped spring 56 is supported by means of grooves 44 (shown as a generally rectangular cut-out area) provided in the interior side wall of cantilever 43 at the interior of recess 47, and side holes 42 formed in the inside wall of opening 45 (FIG. 5). Bent portion 60 of the spring fits into side hole 42 arranged in the inside wall of cantilever 30 which faces opening 36 so that spring 56 will be free from loosening or dislocating during operation (FIG. 5). In this case, the process of mounting print slug 24 onto timing belt 20 with U-shaped spring 56 is exemplarily shown as follows:

1. first, insert the tip of bent portion 60 of U-shaped spring 56 into side hole 42 (see FIG. 5),
2. move it to the position shown by the broken line in FIG. 6,
3. place timing belt 20 between print slug 24 and U-shaped spring 56 as shown in FIG. 6,
4. rotate U-shaped spring 56 with timing belt 20 around bent portion 60 as the fulcrum to fit with print slug 24, and
5. finally, set U-shaped spring member 56 fixed with groove 44 of cantilever 30 as shown by the solid line in FIG. 6. As apparent from the above, leg members 58*a* and 58*b* are placed in contact with teeth 22 of timeing belt 20, and U-shaped spring member 56 clamps or otherwise disposes timing belt 20 toward printing portion 26. Thus, print slug 24 will not experience any horizontal or vertical offset during operation. The demounting process can also be the reverse of the mounting process described above.

Figure 7:
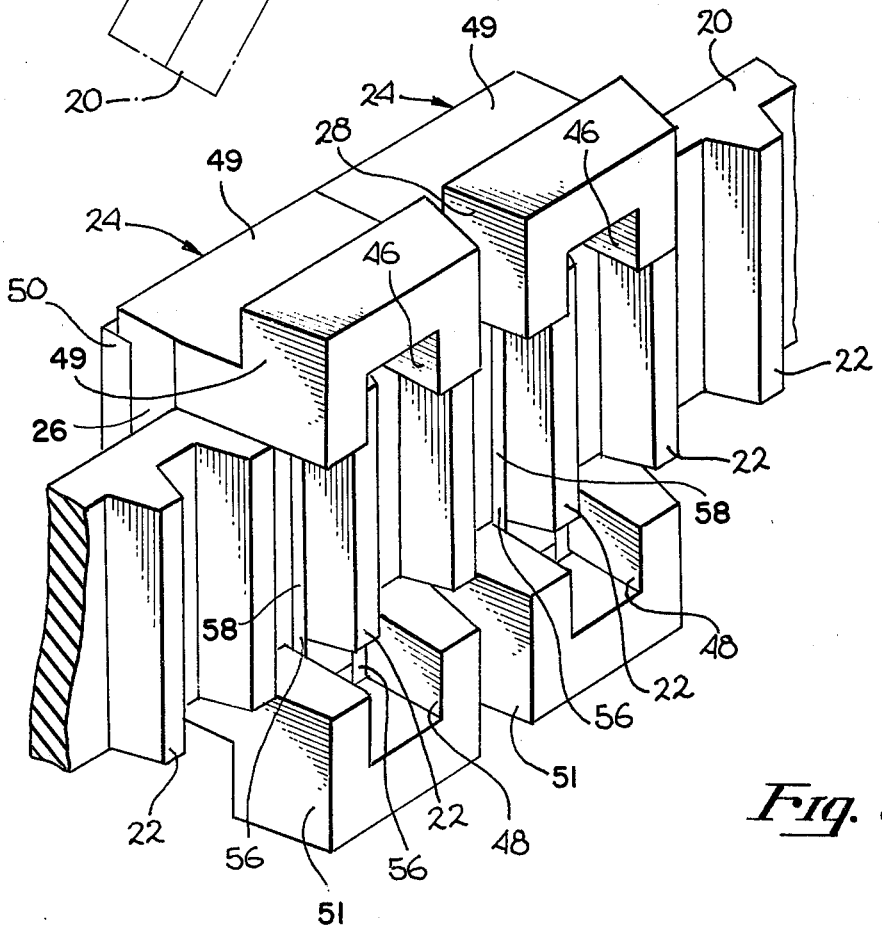
FIG. 7 is a perspective view of the third embodiment of this invention.
Figure 8:
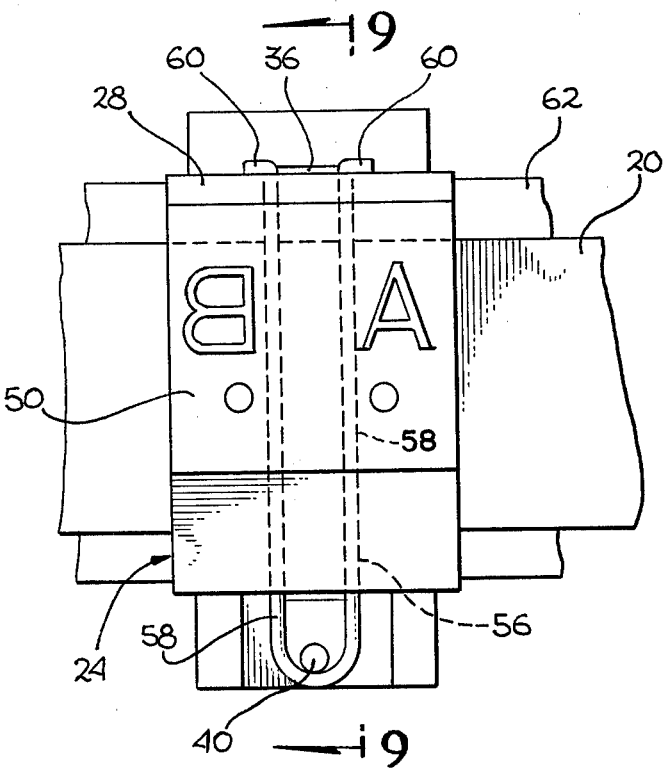
FIG. 8 is a front view of the third embodiment of this invention.
Figure 9:
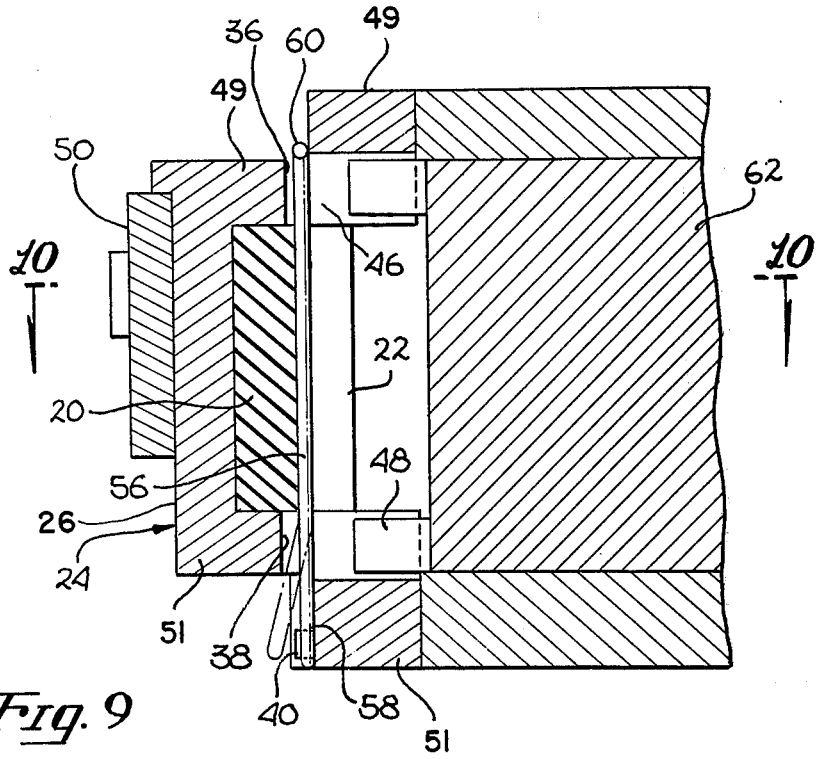
FIG. 9 is a cross-sectional view along Lines IX — IX shown in FIG. 8.
Figure 11:
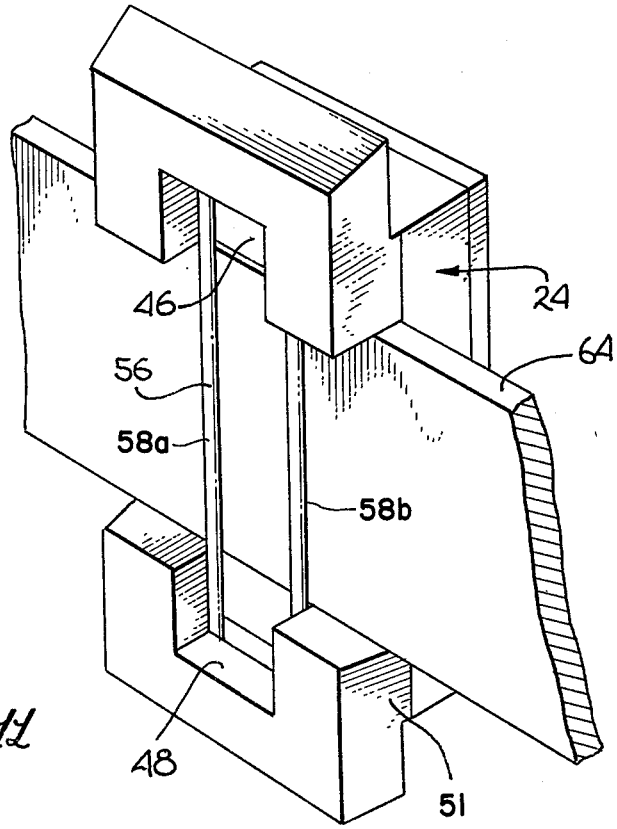
FIG. 11 is a perspective view of a modification of the third embodiment of this invention.

FIGS. 7 through 10 illustrate still another embodiment of this invention. FIG. 7 shows a part of the device of the embodiment which is slightly different from that discussed above in that cantilevers 49 and 51 are provided with recesses 46 and 48 to mesh or otherwise coupled with spring member 56 such that the driving pulley proceeds between each tooth and each U-shaped member. In the operation, driving pulley 62 meshes with intermeshing recesses 46 and 48 rather than with timing belt 20 as shown in FIGS. 9 and 10. In the event driving pulley 62 rotates in the direction shown by arrow E (FIG. 10), timing belt 20 will be under tension at one side and under pressure or compression at the other side. A printing hammer (not shown) is arranged in the side that is under pressure. Print slugs 24 are moved by driving pulley 62 along the printing line in sequence, but the moving process in this case is that print slugs 24 touch each other and are pushed out one after another. Therefore, the printing performance will not be affected by errors such as in measurement or expansion of timing belt 20. Accordingly, as long as the dimension of print slug 24 is measured accurately, the distance between the printed letters will be almost constant and an excellent printing performance can be obtained. In fact, the measurement control of the print slugs is much easier than that of the timing belt 20. In addition to this, since it is not the timing belt 20 but the intermeshing recesses 46 and 48 which gear with driving pulley 62, tooth 22 of the timing belt along with the U-shaped spring member 56 is used only for fixing the print slug 24 to the belt along with U-shaped spring member 56. Therefore, it would be possible to use flat belt 64, as shown in FIG. 11, if the spring force of the U-shaped spring member 56 with respect to the belt is set strong enough to fix the slugs on the belt.

Having now described particular embodiments of the invention in detail, it should be evident that the present invention has a number of advantages with respect to present technology. This invention provides a type belt that has fewer parts thus simplifying the process in the mounting-demounting of print slugs.

Another advantage of the present invention is that it is not necessary to design the U-shaped spring and the driving pulley for the special profile because the devices may be built in such a way that the print slugs gear with the driving pulley. A further advantage of the present invention is that is provides the chain printer with high printing performance without complexity.

What is claimed is:

1. A chain printer having a driving pulley comprising:

a flexible, endless belt having first and second sides;

printing slugs coupled to said belt, said slugs having a printing portion extending outwardly from said first side of said belt and upper and lower cantilever members for positioning said slugs on said belt, said cantilever members extending from said printing portion of said slug across said belt to said second side thereof; and flexible U-shaped spring members for coupling said slugs to said belt, each said U-shaped spring member having first and second spaced-apart leg members, said spring members disposed against said second side of said belt and selectively interlocked in said upper and lower cantilever members, said lower cantilever member having grooves arranged and configured such that each said spring member extends up through said grooves with a section of said spring member remaining in said lower cantilever member, and said upper cantilever member having engaging means for selectively retaining the ends of each said leg member such that said ends may be flexed and selectively released from said upper cantilever member while said section of said spring member in said lower cantilever member remains substantially in place whereby said belt is disposed between said slugs and said U-shaped spring members.

2. The chain printer of claim 1 wherein said driving pulley has a plurality of outwardly extending members, and said second side of said belt has a plurality of tooth members arranged and configured to mesh between said outwardly extending members of said driving pulley.

3. The chain printer of claim 2 wherein alternating tooth members are disposed between said first and second leg members of one of said U-shaped spring members.

4. The chain printer of claim 1 wherein said engaging means are two openings disposed in said upper cantilever member with the end of each said leg member disposed in said openings.

5. The chain printer of claim 1 wherein each said leg member has an outwardly extending projection at the corresponding ends of each said leg member, and said lower cantilever member has a recessed area joining said grooves arranged and configured to selectively permit said leg members to pass therethrough and into said grooves.

6. The chain printer of claim 1 wherein said grooves in said lower cantilever member extend up the length of said lower cantilever member, such that each said first and second leg members are disposed in said grooves, each said first and second leg members have outward extending projections at the ends of each said leg members, and wherein said engaging means are two openings arranged and configured to selectively retain the ends of each said U-shaped spring member therein.

7. A chain printer having a driving pulley comprising:

a flexible, endless belt having first and second sides, said driving pulley having a plurality of outwardly extending members and said second side having a plurality of tooth members arranged and configured to mesh between said outwardly extending members of said driving pulley;

printing slugs coupled to said belt, said slugs having a printing portion extending outwardly from said first side of said belt and upper and lower cantilever members for positioning said slugs on said belt, said cantilever members extending from said printing portion of said slug across said belt to said second side thereof; and U-shaped spring members for coupling said slugs to said belt, each said U-shaped spring member having first and second spaced-apart leg members, said U-shaped spring members disposed against said second side of said belt and selectively interlocked in said cantilever members, said lower cantilever member having grooves arranged and configured such that each said spring member extends up through said grooves in said lower cantilever member with said first and second leg members coupled to said upper cantilever member, each said leg member having an outwardly extending projection at the corresponding end of each said leg member, said projection selectively disposed in an engaging means in said upper cantilever member, whereby said belt is disposed between said slugs and said U-shaped spring members.

* * * * *